US006599260B2

(12) United States Patent
Tucek et al.

(10) Patent No.: US 6,599,260 B2
(45) Date of Patent: Jul. 29, 2003

(54) CHIROPRACTIC PERCUSSOR APPARATUS HAVING COMPACT PERCUSSION-APPLYING HEAD ASSEMBLY CENTRALLY ATTACHED TO RECIPROCATORY PUSH ROD

(76) Inventors: Kevin B. Tucek, 3498 N. San Marcos Pl., #6, Chandler, AZ (US) 85225; John W. Brimhall, 1618 E. Fairfield, Mesa, AZ (US) 85203

( * ) Notice: Subject to any disclaimer, the term of this patent is extended or adjusted under 35 U.S.C. 154(b) by 0 days.

(21) Appl. No.: 09/749,004

(22) Filed: Dec. 27, 2000

(65) Prior Publication Data

US 2002/0082536 A1 Jun. 27, 2002

(51) Int. Cl.[7] ..... A61H 23/00

(52) U.S. Cl. ..... 601/107; 601/108; 601/110; 601/111

(58) Field of Search ..... 601/101, 108, 601/110, 111

(56) References Cited

U.S. PATENT DOCUMENTS

| | | | | | |
|---|---|---|---|---|---|
| 1,269,803 | A | * | 6/1918 | Elmen et al. | 601/101 |
| 1,339,179 | A | | 5/1920 | Elmen | |
| 1,657,765 | A | | 1/1928 | Pasquê | |
| 2,067,991 | A | | 1/1937 | Taylor | |
| 4,079,733 | A | * | 3/1978 | Denton et al. | 601/108 |
| 4,162,675 | A | | 7/1979 | Kawada | 128/55 |
| 4,513,737 | A | * | 4/1985 | Mabuchi | 601/101 |
| 4,827,914 | A | * | 5/1989 | Kamazawa | 601/101 |
| 5,716,332 | A | | 2/1998 | Noble | 601/108 |
| 5,951,501 | A | | 9/1999 | Griner | 601/108 |

OTHER PUBLICATIONS

Prior Art Chiropractic Percussor Apparatus (Figs, 1–3).

* cited by examiner

*Primary Examiner*—Nicholas D. Lucchesi
*Assistant Examiner*—Fenn C Mathew
(74) *Attorney, Agent, or Firm*—Flanagan & Flanagan; John R. Flanagan

(57) ABSTRACT

A chiropractic percussor apparatus includes a main housing adapted to be held by a user, an electric motor mounted in the main housing and having a rotary output shaft extending therefrom, an extension housing attached to an end of the main housing and extending outwardly therefrom and having an outer end defining an opening, an elongated push rod eccentrically mounted at an inner end on the rotary output shaft of the electric motor and extending through the extension housing to an outer end of the push rod having a central hole, a flexible coupler assembly supported by the outer end of the extension housing and coupled to the outer end of the push rod so as to permit the outer end of the push rod to undergo reciprocal lengthwise movement and wobbling side-to-side movement relative to the outer end of the extension housing, and a percussion-applying head assembly only centrally attached to the outer end of the push rod at the central hole therein.

11 Claims, 7 Drawing Sheets

CHIROPRACTIC PERCUSSOR APPARATUS HAVING COMPACT PERCUSSION-APPLYING HEAD ASSEMBLY CENTRALLY ATTACHED TO RECIPROCATORY PUSH ROD

BACKGROUND OF THE INVENTION

1. Field of the Invention

The present invention generally relates to a chiropractic percussor apparatus for use in a chiropractic treatment to apply percussion-type repetitive force to the human body and, more particularly, is concerned with a chiropractic percussor apparatus having a compact percussion head assembly that is centrally attached to a force-transmitting reciprocatory push rod of the apparatus.

2. Description of the Prior Art

Chiropractic adjustments of the spinal vertebrae of a human body involve the application of pressure or force in a known manner directly to the human body by the hands of a chiropractor or by a chiropractic percussor apparatus used by the chiropractor. An example of such chiropractic percussor apparatus found in the prior patent art is the one disclosed in U.S. Pat. No. 4,079,733 to Denton et al.

Another example of a prior art chiropractic percussor apparatus is the one illustrated in FIGS. 1 to 3. The apparatus of FIGS. 1 to 3, generally designated 10, includes a main housing 12, an electric motor 14 in the main housing 12, and a speed adjustment knob 16 and an on/off push button 18 on the main housing 12. The main housing 12 defines an interior cavity 20 and is adapted to be gripped by a user to hold the apparatus 10 during use. The electric motor 14 is disposed in the cavity 20 of the main housing 12 and has a rotary output shaft 22 extending from front ends 14A, 12A of the motor 14 and main housing 12. The speed adjustment knob 16 and on/off push button 18 are mounted to a rear end 12B of the main housing 12 and connected to the motor 14 such that by turning the knob 16 and/or depressing the button 18 the rotational speed of the output shaft 22 can be varied and/or the motor 14 can be alternately turned on and off. The electric motor 14 receives electrical power via an electrical cord 24 connected to a separate power conversion module 26 which, in turn, is plugged into a conventional AC outlet.

The apparatus 10 of FIGS. 1 to 3 further includes an extension housing 28, a cam 30 eccentrically mounted on an outer end 22A of the rotary output shaft 22 of the motor 14, an elongated push rod 32 mounted at an inner end 32A on the cam 30, a flexible coupler assembly 33 coupling an outer end 32B of the push rod 32 to an outer end 28A of the extension housing 28, and a percussion head assembly 34 supported on the outer end 32B of the push rod 32. The extension housing 28 is attached at an inner end 28B to the front end 12A of the main housing 12 and extends in a transverse relationship thereto and outwardly therefrom such that the main and extension housings 12, 28 together have a L-shaped configuration. The extension housing 28 further defines an interior chamber 36 and its outer end 28A has an annular shape and forms an opening 38 and is spaced from the front end 12A of the main housing 12. The push rod 32 extends through the extension housing 28 from the cam 30 to the opening 38 at the outer end 28A of the extension housing 28. The inner end 32A of the push rod 32 has an opening 40 which receives therein the cam 30 such that the push rod 32 at its inner end 32A surrounds the cam 30. The flexible coupler assembly 33 includes an annular clamp 42 and a circular diaphragm 44 provided at the outer end 28A of the extension housing 28 and coupling the outer end 32B of the push rod 32 thereto so as to permit the outer end 32B of the push rod 32 to undergo reciprocal lengthwise movement and wobbling side-to-side movement relative to the outer end 28A of the extension housing 28. The diaphragm 44 is formed by a flexible sheet of rubber and is clamped about its peripheral portion 44A between the annular clamp 42 and an annular flange 46 on the outer end 28A of the extension housing 28. The annular clamp 42 is secured to the annular flange 46 by a plurality of screws 48 extending through the peripheral portion 44A of the diaphragm 44. The diaphragm 44 also has a main portion 44B which extends across the opening 38 of the outer end 28A of the extension housing 28 which is adjacent to an inner surface 44C of the diaphragm 44 and across a central bore 50 through the annular clamp 42 which is adjacent to an outer surface 44D of the diaphragm 44.

The percussion head assembly 34 of the apparatus 10 includes a coupler body 52 and a contact pad 54. The coupler body 52 extends through the central bore 50 of the annular clamp 42 to the main portion 44B of the diaphragm 44 and outwardly from the annular clamp 42. The coupler body 52 has a plurality of passages 56 defined therethrough radially outwardly from and circumferentially spaced about a central threaded hole 58 defined through the coupler body 52. A plurality of fasteners 60 are inserted through the passages 56 of the coupler body 52 and screwed into holes 62 tapped in the outer end 32B of the push rod 32 such that the main portion 44B of the diaphragm 44 is clamped between the coupler body 52 and the outer end 32B of the push rod 32 with the main portion 44B of the diaphragm 44 extending radially outwardly beyond holes 44E in the diaphragm 44 where the fasteners 60 pass through the diaphragm 44. The contact pad 54 has a stiff circular base plate 64, a fastener 66 fixedly mounted centrally thereon and extending outwardly from an inner surface 64A of the base plate 64, and a disc 68 of resilient compressible foam material attached to an outer surface 64B of the base plate 64. The fastener 66 removably screws into the central threaded hole 58 of the coupler body 52 so as to mount the contact pad 54 on the outer side 52A of the coupler body 52 as the inner side 52B of the coupler body 52 is held against the main portion 44B of the diaphragm 44 by the fasteners 60.

Upon depressing of the button 18, rotation of the output shaft 22 of the motor 14 occurs and the cam 30 thereon is eccentrically rotated causing the push rod 32 to undergo a reciprocal lengthwise movement and a wobbling side-to-side movement in the extension housing 28 so as to correspondingly impose percussive and massaging actions on a surface, such as a part of the human body, against which the contact pad 54 is applied by the user holding the apparatus 10.

A problem of this prior art apparatus 10 is the way in which the diaphragm 44 of the percussion head assembly 34 is secured to the outer end 28A of the extension housing 28 and the outer end 32B of the push rod 32. Such securement which does not permit any flexing at the peripheral and main portions 44A, 44B of the diaphragm 44 leaves only a narrow annular band-like portion 44F of the diaphragm 44 extending between and interconnecting the peripheral and main portions 44A, 44B where flexing of the diaphragm 44 can occur to accommodate the reciprocatory and side-to-side motions of the push rod 32. The provision of only the narrow band-like portion 44F for flexing of the diaphragm 44 overly restricts the size of the path of motion of the outer end 32B of the push rod 32 and thereby of the contact pad 54 for delivery of the percussive and massaging actions on the human body.

Consequently, a need exists for an innovation that will provide a percussion head assembly that will overcome the aforementioned problem of the prior art chiropractic percussor apparatus without introducing any new problems in place thereof.

SUMMARY OF THE INVENTION

The present invention provides an enhanced chiropractic percussor apparatus designed to satisfy the aforementioned need. The apparatus of the present invention has a compact percussion head assembly having a diaphragm which is secured to the extension housing and outer end of the reciprocatory push rod of the enhanced apparatus and a contact pad which is only centrally attached to the outer end of the push rod so as to permits a substantially wider annular band-like portion of the diaphragm to flex which, in turn, expands the size of the path of motion of the outer end of the push rod and thereby of the contact pad for delivery of percussive and massaging actions on the human body which are more effective than the corresponding actions delivered by the prior art apparatus. Also, the compact character of the percussion head assembly and its central connection to the end of the reciprocatory rod provides a more reliable and stable assembly than is found in the prior art apparatus.

Accordingly, the present invention is directed to a chiropractic percussor apparatus which comprises: (a) a main housing adapted to be held by a user; (b) an electric motor mounted in the main housing and having a rotary output shaft extending therefrom; (c) an extension housing attached to an end of the main housing and extending outwardly therefrom and having an outer end defining an opening; (d) an elongated push rod eccentrically mounted at an inner end on the rotary output shaft of the electric motor and extending through the extension housing to an outer end of the push rod having a central hole; (e) a flexible coupler assembly supported by the outer end of the extension housing and coupled to the outer end of the push rod so as to permit the outer end of the push rod to undergo reciprocal lengthwise movement and wobbling side-to-side movement relative to the outer end of the extension housing; and (f) a percussion-applying head assembly only centrally attached to the outer end of the push rod at the central hole therein.

The flexible coupler assembly includes an annular flange member attached at an inner surface to the outer end of the extension housing and mounted across the opening thereof. The annular flange member has an aperture receiving the outer end of the push rod and an outer surface facing away from the extension housing. The flexible coupler assembly further includes a diaphragm of resilient flexible material disposed on the outer surface of the annular flange member and having a central aperture. The flexible coupler assembly still further includes means for attaching the diaphragm about a peripheral portion thereof to the annular flange member and for attaching the diaphragm at a central portion thereof about the central aperture thereof to the outer end of the push rod about the central hole in the push rod such that the diaphragm has an intermediate annular portion extending between the peripheral and central portions thereof that is free to flex so as to permit the reciprocal lengthwise movement and the wobbling side-to-side movement of the outer end of the push rod relative to the outer end of the extension housing.

The percussion-applying head assembly includes a pad support member having a plate and a single fastener mounted centrally on the plate and extending outwardly therefrom through the central aperture of the diaphragm and tightly fitted into the central hole in the outer end of the push rod so as to mount the pad support member directly to the outer end of the push rod by the centrally-located single fastener extending through the central aperture in the central portion of the diaphragm. The percussion-applying head assembly further includes a contact pad mounted to the plate of the pad support member such that rotation of the output shaft of the motor causes the outer end of the push rod and the pad support member and contact pad therewith to undergo the reciprocal lengthwise motion and the wobbling side-to-side motion so as to impose percussive and massaging actions on a surface against which the contact pad is applied by the user.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
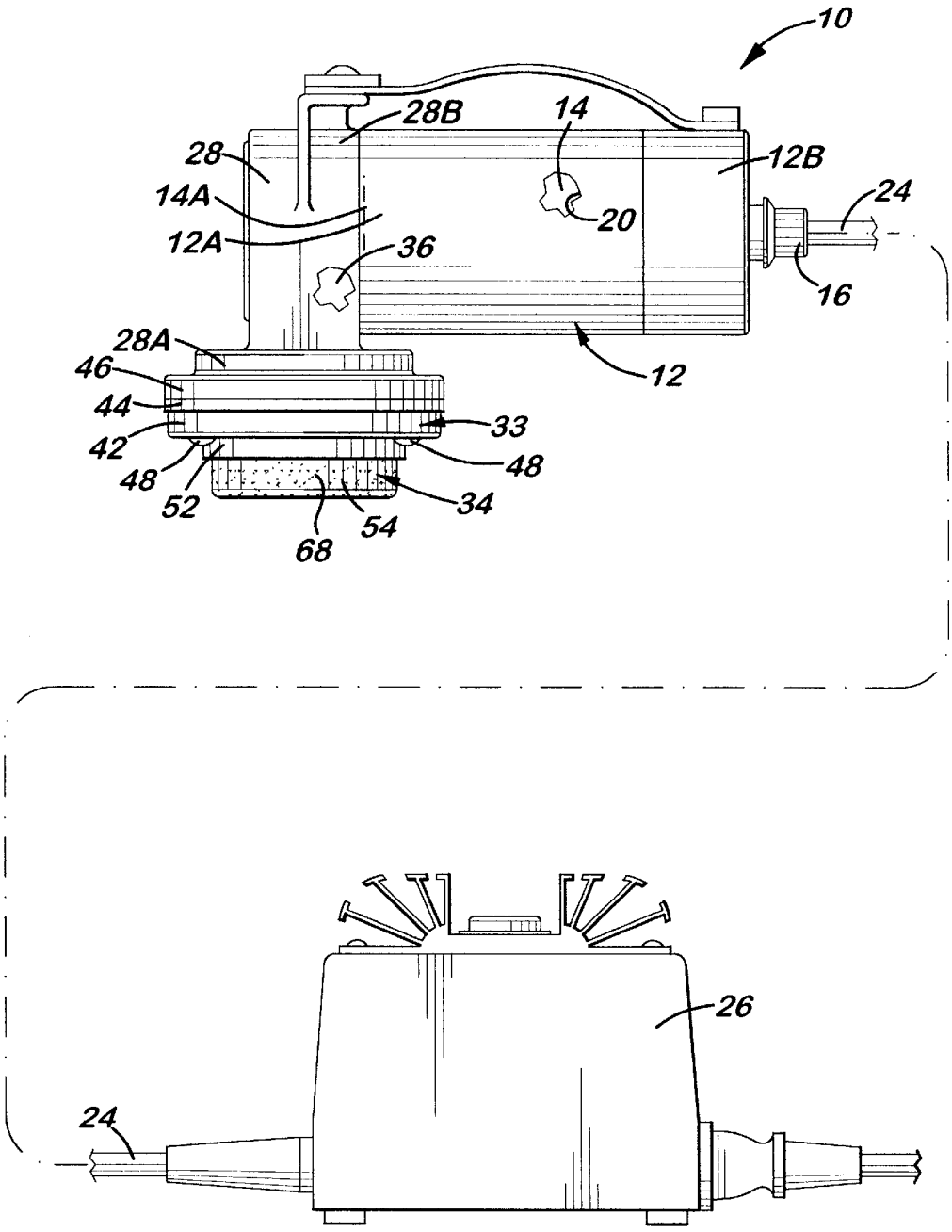
FIG. 1 (PRIOR ART)
FIG. 1 is a side elevational view of the prior art chiropractic percussor apparatus that has been described in detail in the background section of this application.

Referring to the drawings and particularly to FIGS. 4 to 8, there is illustrated an enhanced chiropractic percussor apparatus of the present invention, generally designated 70. Similar to the prior art apparatus 10, the enhanced apparatus 70 includes a main housing 72, an electric motor 74 in the main housing 72, and a speed adjustment knob 76 and an on/off push button 78 on the main housing 72. The main housing 72 defines an interior cavity 80 and is adapted to be gripped by a user to hold the apparatus 70 during use. The electric motor 74 is disposed in the cavity 80 of the main housing 72 and has a rotary output shaft 82 extending from front ends 74A, 72A of the motor 74 and main housing 72. The speed adjustment knob 76 and on/off push button 78 are mounted to a rear end 72B of the main housing 72 and connected to the motor 74 such that by turning the knob 76 and/or depressing the button 78 the rotational speed of the output shaft 82 can be varied and/or the motor 74 can be alternately turned on and off. The electric motor 74 receives electrical power via an electrical cord 84 connected to a separate power conversion module 86 which, in turn, is plugged into a conventional AC outlet. Also, a sheet of insulative material (not shown) is applied about the exterior surface of the main housing 72 to provide a heat barrier between the housing 74 and the user's hand.

Figure 2:
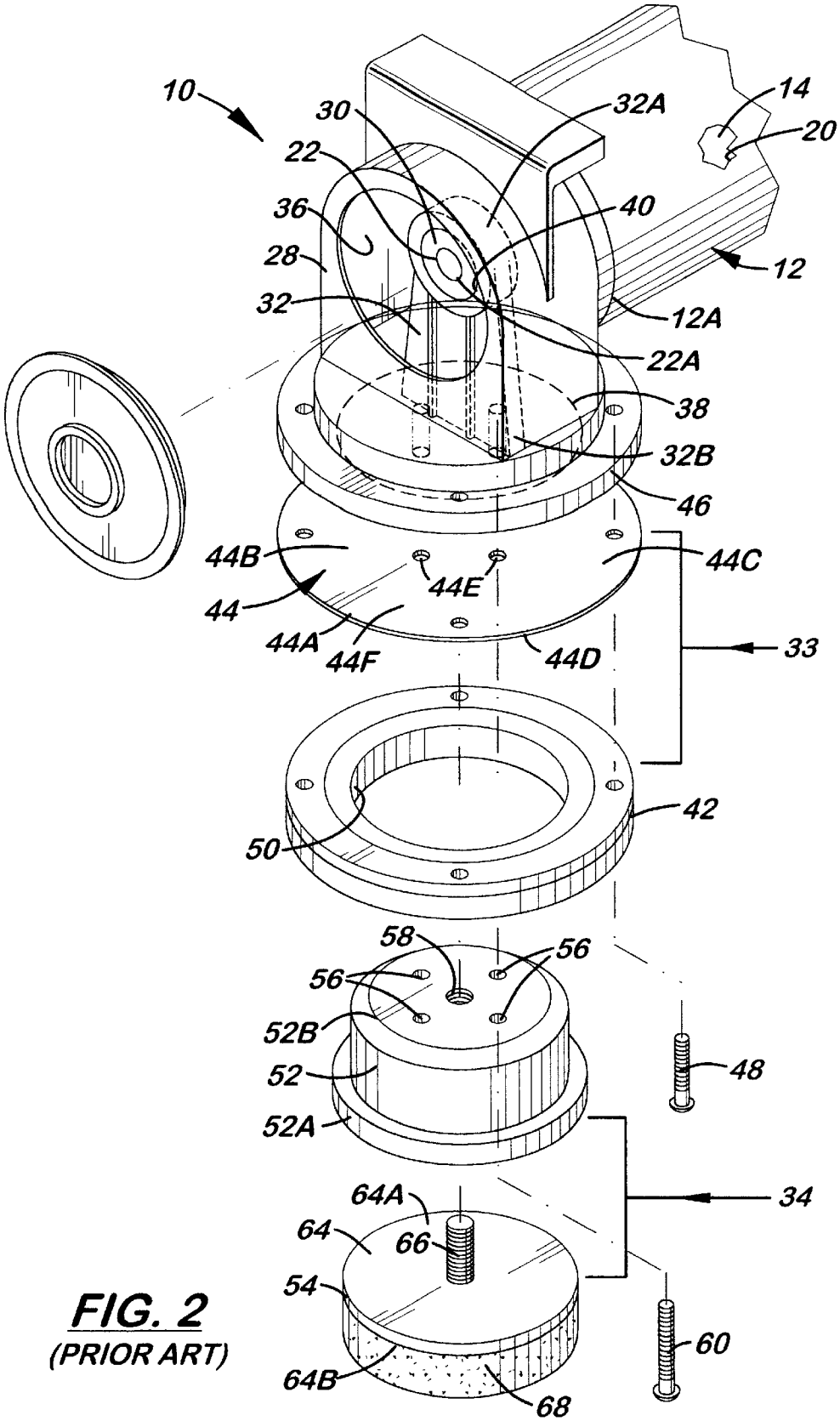
FIG. 2 (PRIOR ART)
FIG. 2 is an enlarged fragmentary perspective view of the apparatus of FIG. 1.
Figure 3:
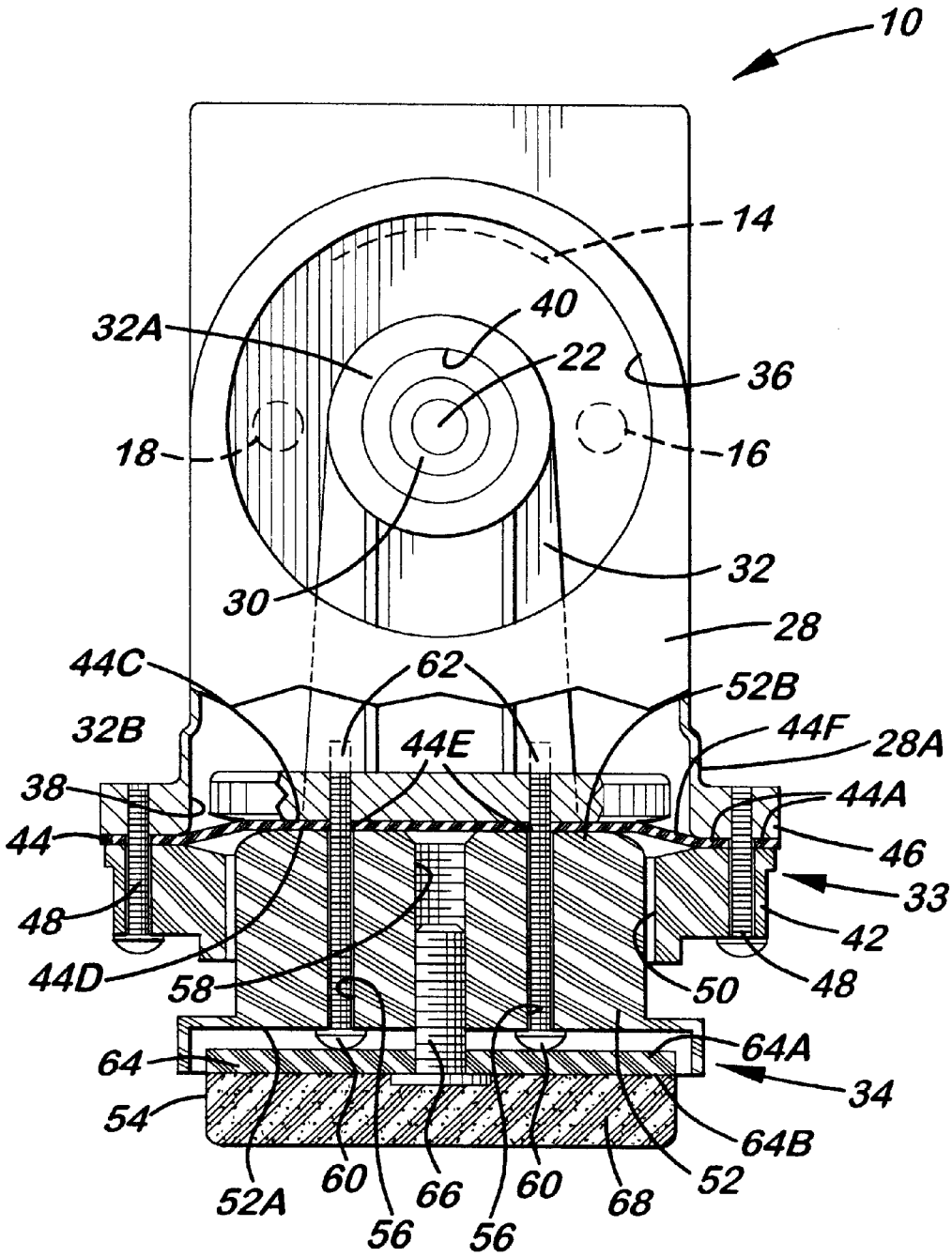
FIG. 3 (PRIOR ART)
FIG. 3 is a longitudinal sectional view of a percussion head assembly of the prior art apparatus of FIG. 1.
Figure 4:
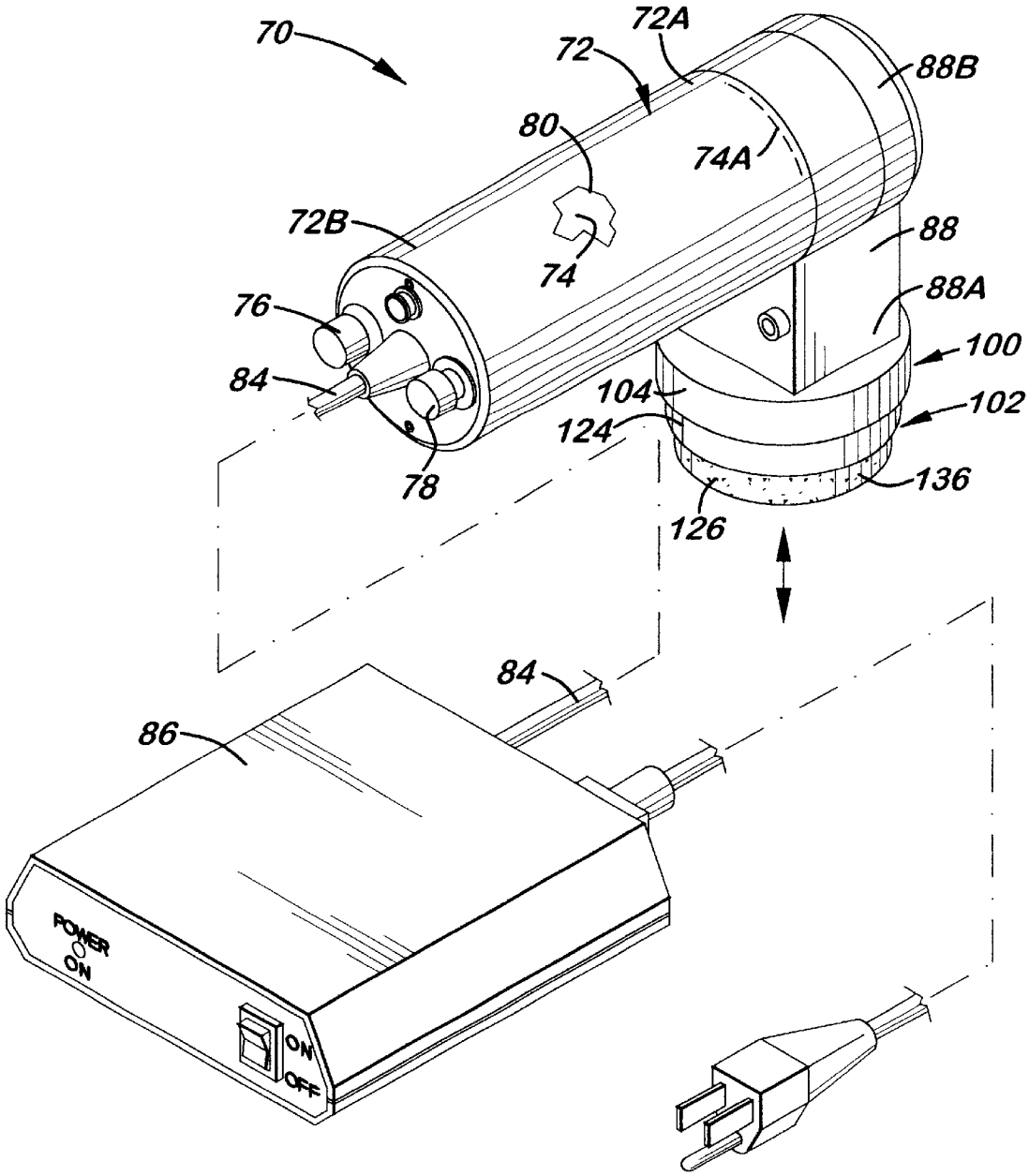
FIG. 4 is a perspective view of a chiropractic percussor apparatus of the present invention.
Figure 5:
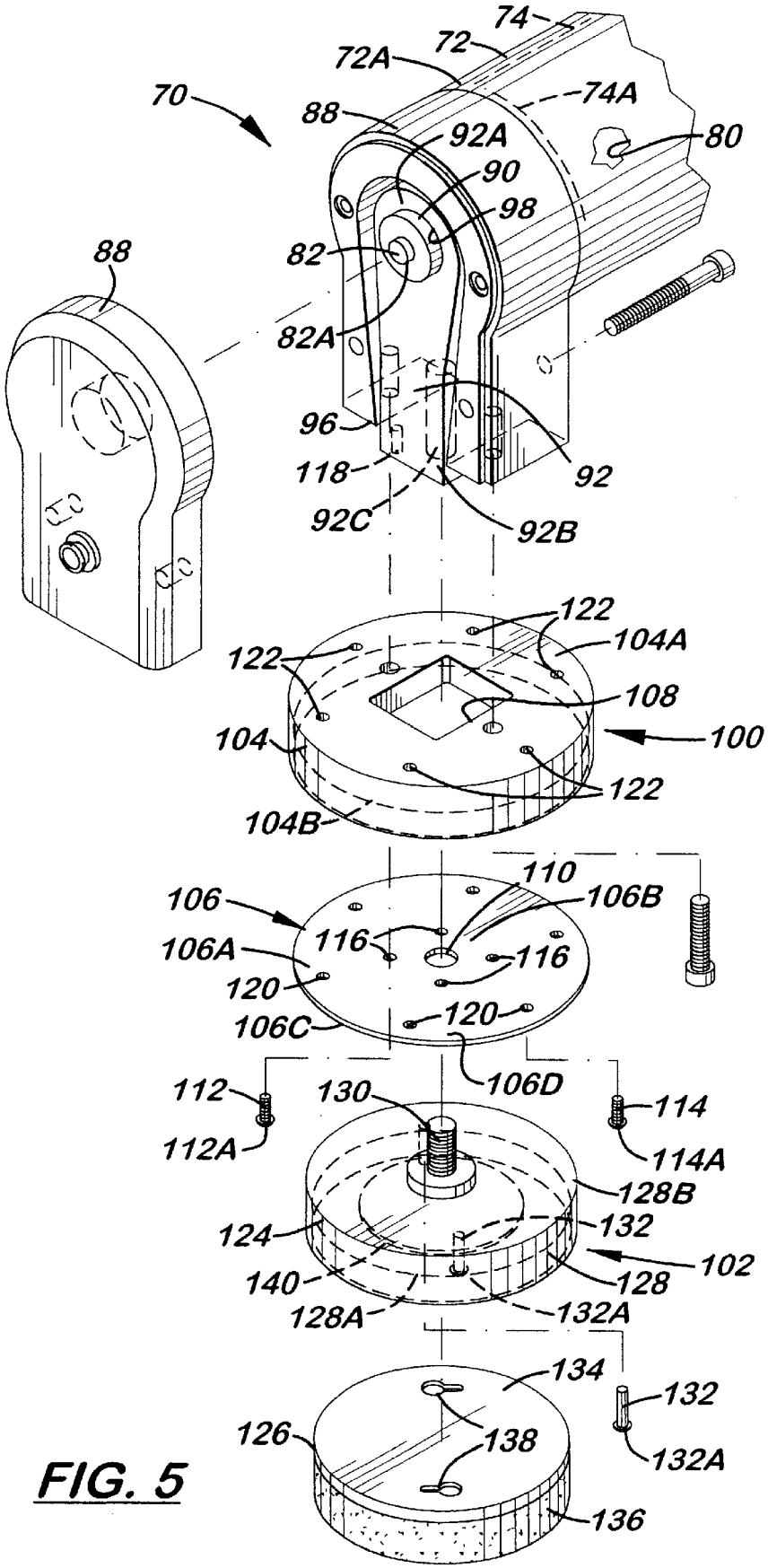
FIG. 5 is an enlarged fragmentary perspective view of the apparatus of FIG. 4.
Figure 6:
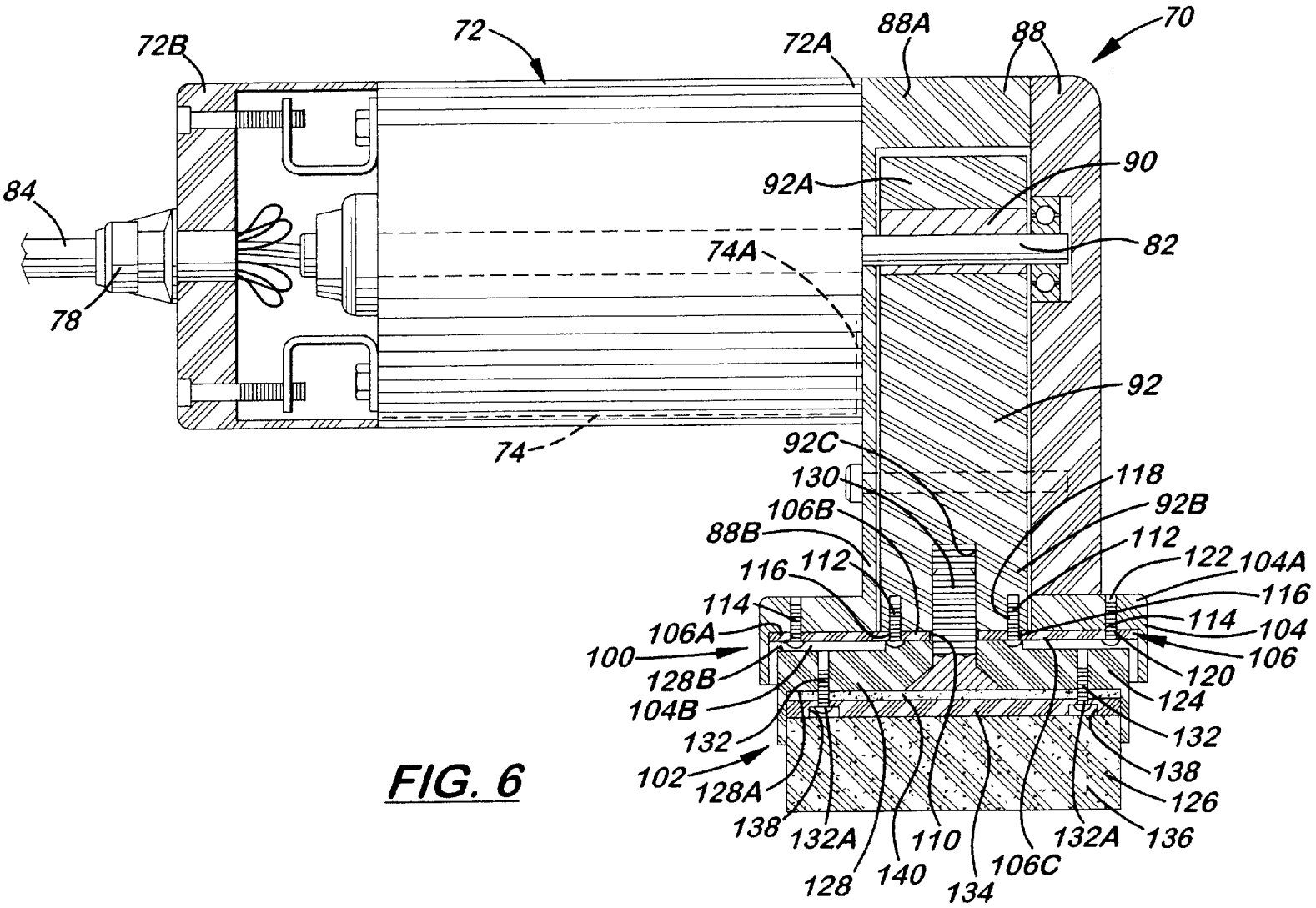
FIG. 6 is a longitudinal sectional view of a compact percussion head assembly of the apparatus of FIG. 4.
Figure 8:
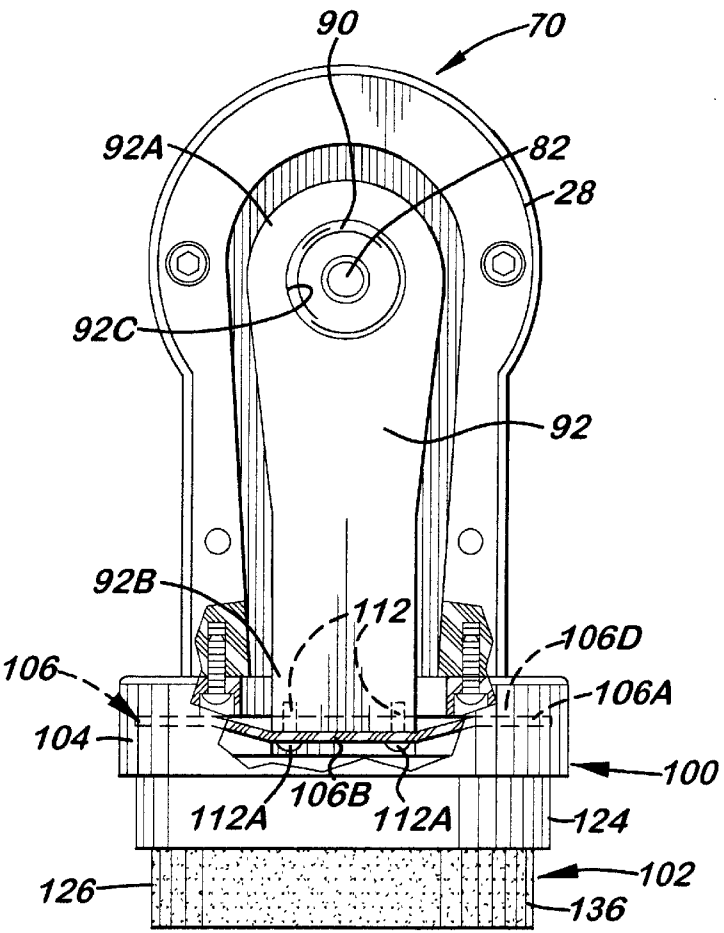
FIG. 8 is a front elevational view of the apparatus of FIG. 4 with a portion broken away to show the percussion head assembly in an extended position.
Figure 7:
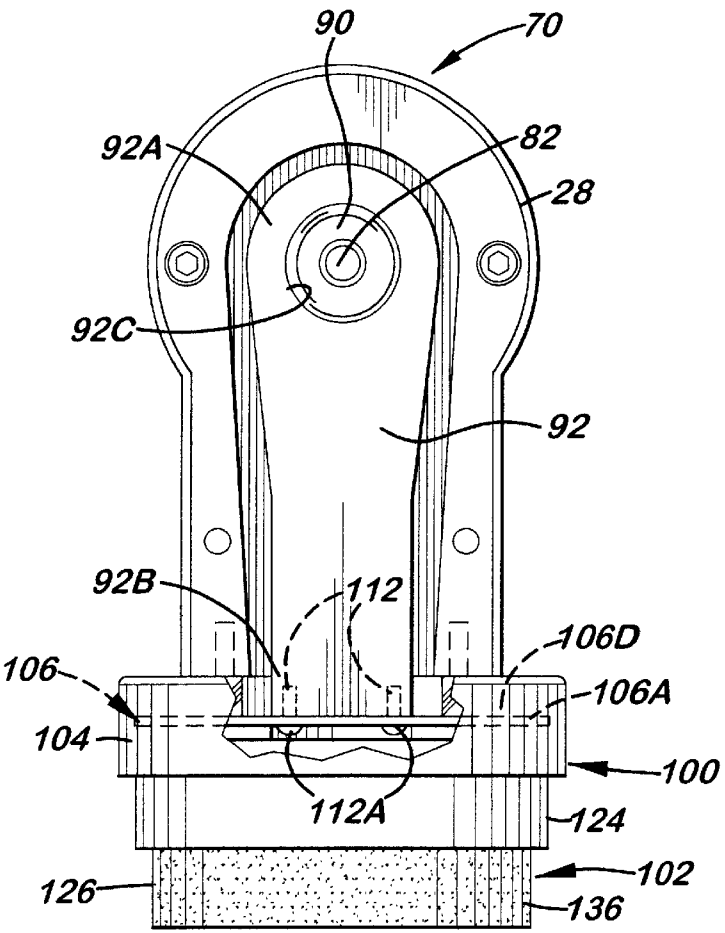
FIG. 7 is a front elevational view of the apparatus of FIG. 4 with a portion broken away to show the percussion head assembly in a retracted position.

Also, similar to the prior art apparatus 10, the enhanced apparatus 70 of FIGS. 1 to 3 further includes an extension housing 88, a cam 90 eccentrically mounted on an outer end 82A of the rotary output shaft 82 of the motor 74, and an elongated push rod 92 mounted at an inner end 92A on the cam 90. The extension housing 88 is attached at an inner end 88B to the front end 72A of the main housing 72 and extends in a transverse relationship thereto and outwardly therefrom such that the main and extension housings 72, 88 together have a generally L-shaped configuration. The extension housing 88 further defines an interior chamber 94 and its outer end 88A has an annular shape and forms an opening 96 and is spaced from the front end 72A of the main housing 72. The push rod 92 extends through the extension housing 88 from the cam 90 to the opening 96 at the outer end 88A of the extension housing 88. The inner end 92A of the push rod 92 has an opening 98 which receives therein the cam 90 such that the push rod 92 at its inner end 92A surrounds the cam 90.

The enhanced apparatus 70 also includes a flexible coupler assembly 100 and a percussion-applying head assembly 102 which both are substantially different from that of the prior art apparatus 10. The flexible coupler assembly 100 is supported on by an outer end 88A of the extension housing 88 and is coupled to an outer end 92B of the push rod 92 so as to permit the outer end 92B of the push rod 92 to undergo reciprocal lengthwise movement and wobbling side-to-side movement relative to the outer end 88A of the extension housing 88. The percussion-applying head assembly 100 is only centrally attached to the outer end 92A of the push rod 92 at the central hole 92C therein.

More particulary, the flexible coupler assembly 100 includes an annular flange member 104 and a diaphragm 106. The annular flange member 104 is attached at an inner surface 104A to the outer end 88A of the extension housing 88 and mounted across the opening 96 thereof. The annular flange member 104 has an aperture 108 which receives the outer end 92B of the push rod 92 and an outer surface 104B facing away from the extension housing 88. The diaphragm 106 is a circular sheet of resilient flexible material, such as rubber, disposed on the outer surface 104B of the annular flange member 104 and having a central aperture 110. The flexible coupler assembly 10 further includes means for attaching the diaphragm 106 about a peripheral portion 106A thereof to the annular flange member 104 and for attaching the diaphragm 106 at a central portion 106B thereof about the central aperture 110 thereof to the outer end 92B of the push rod 92 about the central hole 92C in the push rod 92. The means for attaching the central portion 106B and the peripheral portion 106A of the diaphragm 106 respectively to the push rod 92 and the annular flange member 104 includes a first plurality of fasteners 112 and a second plurality of fasteners 114. The fasteners 112 of the first plurality insert through inner holes 116 through the central portion 106B of the diaphragm 106 and are screwed into corresponding holes 118 tapped in the outer end 92B of the push rod 92 about the central hole 92C therein. The fasteners 112 have enlarged heads 112A which overlie and engage an outer surface 106C of the diaphragm 106 so as to hold the central portion 106B thereof against the outer end 92B of the push rod 92. The fasteners 114 of the second plurality insert through outer holes 120 through the peripheral portion 106A of the diaphragm 106 and are screwed into corresponding holes 122 tapped in the outer surface 104B of the annular flange member 104 about the aperture 108 thereof. The fasteners 114 have enlarged heads 114A which overlie and engage the outer surface 106C of the diaphragm 106 so as to hold the peripheral portion 106A thereof against the annular flange member 104. The diaphragm 106 further has an intermediate annular portion 106D extending between the peripheral and central portions 106A, 106B thereof that is free to flex so as to permit the reciprocal lengthwise movement and the wobbling side-to-side movement of the outer end 92B of the push rod 92 relative to the outer end 88A of the extension housing 88.

The percussion-applying head assembly 102 includes a pad support member 124 and a contact pad 126. The pad support member 124 has a circular plate 128 and a single fastener 130 fixedly mounted centrally on the plate 128 and extending outwardly from an inner side 128B of the plate 128, facing toward the push rod 92 and extension housing 88, and through the central aperture 110 of the diaphragm 106 and tightly screwed into the central hole 92C in the outer end 92B of the push rod 92 so as to mount the pad support member 124 directly to the outer end 92B of the push rod 92 by the centrally-located single fastener 130 extending through the central aperture 110 in the central portion 106B of the diaphragm 106. The plate 128 of the pad support member 124 has a pair of fasteners 132 attached thereon and extending outwardly from an outer side 128A of the plate 128 facing away from the outer end 88A of the extension housing 88. The plate 128 and thus the percussion-applying head assembly 102 extend outwardly and laterally beyond the outer end 92B of the push rod 92 and overlie the outer surface 104B of the annular flange member 104 such that the head assembly 102 is separate from and overlies the enlarged heads of the first and second pluralities of fasteners 112, 114 that engage and attach the diaphragm 106 to the outer end 92B of the push rod 92 and the outer surface 104B of the annular flange member 104.

The contact pad 126 is mounted to the plate 128 of the pad support member 124 such that rotation of the output shaft 82 of the electric motor 74 causes the outer end 92B of the push rod 92 and the pad support member 124 and contact pad 126 therewith to undergo the reciprocal lengthwise motion and the wobbling side-to-side motion so as to impose percussive and massaging actions on a surface against which the contact pad 126 is applied by the user holding the apparatus 70. The contact pad 126 has a circular base 134 and a disc 136 of compressible foam material attached on the base 134. The base 134 has a pair of keyholes 138 formed therein for receiving the pair of fasteners 132 on the plate 128 of the pad support member 124. The plate 128 of the pad support member 124 also has a disc 140 of material thereon adapted to be compressed by movement of the base 134 of the contact pad 126 into contact therewith and toward the plate 128 to insert the pair of fasteners 132 on the plate 128 through the keyholes 138 in the base 134 and to expand outward and thereby lift the contact pad 126 away from the plate 128, after rotation of the contact pad 126 relative to the plate 128, so as to hold enlarged heads 132A on the fasteners 132 in engagement behind portions of the base 134 adjacent to the keyholes 138 in the base 134.

Upon depressing of the button 78, rotation of the output shaft 82 of the motor 74 occurs and the cam 90 thereon is eccentrically rotated causing the push rod 92 and thereby the outer end 92A thereof to concurrently undergo the reciprocal lengthwise movement and the wobbling side-to-side movement relative to the outer end 88A of the extension housing 88 so as to impose the percussive and massaging actions on a surface, such as a part of the human body, against which the contact pad 126 is applied by the user holding the enhanced apparatus 70. Because the diaphragm 106 of the flexible coupling assembly 100 of the enhanced apparatus 70 is secured to the outer end 88A of the extension housing 88 and the outer end 92A of the push rod 92 and because the contact pad 126 is only centrally attached to the outer end 92A of the push rod 92 between the locations where the central portion 106B of the diaphragm 106 is attached to the push rod 92, the annular intermediate portion 106D of the diaphragm 106 that is permitted to flex is substantially wider in the case of the enhanced apparatus 70, than in the case of the prior art apparatus 10, so as to provide expansion of the size of the path of motion of the outer end 92A of the push rod 92 of the enhanced apparatus 70, compared to the restricted path of motion of the outer end 92B of the push rod 92 of the prior art apparatus 10, which results in the delivery of percussive and massaging actions on the human body by the enhanced apparatus 70 of the present invention which are more effective than in the case the prior art apparatus 10.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

We claim:

1. A chiropractic percussor apparatus, comprising:

(a) a main housing adapted to be held by a user;

(b) an electric motor mounted in said main housing and having a rotary output shaft extending therefrom;

(c) an extension housing attached to an end of said main housing and extending outwardly therefrom and having an outer end defining an opening;

(d) an elongated push rod eccentrically mounted at an inner end on said rotary output shaft of said electric motor and extending through said extension housing to an outer end of said push rod having a central hole;

(e) a flexible coupler assembly supported by said outer end of said extension housing and coupled to said outer end of said push rod so as to permit said outer end of said push rod to undergo reciprocal lengthwise movement and wobbling side-to-side movement relative to said outer end of said extension housing, said flexible coupler assembly including (i) an annular flange member attached at an inner surface to said outer end of said extension housing and mounted across said opening thereof, said annular flange member having an aperture receiving said outer end of said push rod and an outer surface facing away from said extension housing, (ii) a diaphragm formed by a sheet of resilient flexible material disposed on said outer surface of said annular flange member and having a central aperture, and (iii) means for attaching said diaphragm about a peripheral portion thereof to said annular flange member and for attaching said diaphragm at a central portion thereof about said central aperture thereof to said outer end of said push rod about said central hole in said push rod such that said diaphragm has an intermediate annular portion extending between said peripheral and central portions thereof that is free to flex so as to permit said reciprocal lengthwise movement and said wobbling side-to-side movement of said outer end of said push rod relative to said outer end of said extension housing, said means for attaching said central portion of said diaphragm to said outer end of said push rod including a first plurality of fasteners extending through holes in said diaphragm and fastened to said outer end of said push rod and having enlarged heads which overlie and engage an outer surface of said diaphragm so as to hold said central portion thereof against said outer end of said push rod, said means for attaching said peripheral portion of said diaphragm to said annular flange member including a second plurality of fasteners extending through holes in said diaphragm and fastened to said outer surface of said annular flange member and having enlarged heads which overlie and engage said outer surface of said diaphragm so as to hold said peripheral portion thereof against said outer surface of said annular flange member; and (f) a percussion-applying head assembly only centrally attached to said outer end of said push rod at said central hole therein and extending outwardly and laterally beyond said outer end of said push rod and overlying said outer surface of said annular flange member such that said percussion-applying head assembly is separate from and overlies said enlarged heads of said first and second pluralities of fasteners that engage and attach said diaphragm to said outer end of said push rod and said outer surface of said annular flange member, said percussion-applying head assembly including:

(i) a pad support member having a plate and a single fastener mounted centrally on said plate and extending outwardly therefrom through said central aperture of said diaphragm and tightly fitted into said central hole in said outer end of said push rod so as to mount said plate of said pad support member directly to said outer end of said push rod by said centrally-located single fastener extending through said central aperture in said central portion of said diaphragm, said plate of said pad support member having a pair of fasteners attached thereon and extending outwardly from a side of said plate facing away from said outer end of said extension housing, and (ii) a contact pad mounted to said plate of said pad support member such that rotation of said output shaft of said motor causes said outer end of said push rod and said pad support member and contact pad therewith to undergo said reciprocal lengthwise motion and said wobbling side-to-side motion so as to impose percussive and massaging actions on a surface against which said contact pad is applied by the user holding said apparatus, said contact pad having a base and a disc of compressible foam material attached on said base, said base having a pair of keyholes formed therein for receiving said fasteners on said plate of said pad support member, (iii) said plate of said pad support member also having a disc of material adapted to be compressed by movement of said base of said contact pad into contact therewith and toward said plate to insert said fasteners on said plate through said keyholes in said base and to expand outwardly and thereby lift said contact pad away from said plate, after rotation of said contact pad relative to said plate, so as to hold enlarged heads on said fasteners in engagement behind portions of said base adjacent to said keyholes in said base.

2. A chiropractic percussor apparatus, comprising:

(a) a main housing adapted to be held by a user;

(b) an electric motor mounted in said main housing and having a rotary output shaft extending therefrom;

(c) an extension housing attached to an end of said main housing and extending outwardly therefrom and having an outer end defining an opening;

(d) an elongate push rod eccentrically mounted at an inner end of said rotary output shaft of said electric motor and extending through said extension housing to an outer end of said push rod having a central hole;

(e) a flexible coupler assembly supported by said outer end of said extension housing and coupled to said outer end of said push rod so as to permit said outer end of said push rod to undergo reciprocal lengthwise movement and wobbling side-to-side movement relative to said outer end of said extension housing; and (f) a percussion head assembly only centrally attached to said outer end of said push rod at said central hole therein, said percussion head assembly including (i) a pad support member having a plate, a single fastener mounted centrally on said plate and extending outwardly therefrom and tightly fitted into said central hole in said outer end of said push rod so as to mount said pad support member directly to said outer end of said push rod, and a pair of fasteners attached on said plate at locations spaced from opposite sides of said single fastener and extending outwardly from a side of said plate facing away from said outer end of said extension housing, (ii) contact pad having a base with a pair of keyholes formed therein for receiving said pair of fasteners on said plate of said pad support member to mount said contact pad to said plate such that rotation of said output shaft of said motor causes said outer end of said push rod and said pad support member and contact pad therewith to undergo said reciprocal lengthwise motion and said wobbling side-to-side motion so as to impose percussive and massaging actions on a surface against which said contact pad is applied by the user holding said apparatus, said plate of said pad support member also having a disc of material adapted to be compressed by movement of said base of said contact pad into contact therewith and toward said plate to insert said pair of fasteners on said plate through said keyholes in said base and to expand outward and thereby lift said contact pad away from said plate, after rotation of said contact pad relative to said plate, so as to hold enlarged heads on said pair of fasteners in engagement behind portions of said base adjacent to said keyholes in said base.

3. The apparatus of claim 2 wherein said flexible coupler assembly includes an annular flange member attached at an inner surface to said outer end of said extension housing and mounted across said opening thereof, said annular flange member having an aperture receiving said outer end of said push rod and an outer surface facing away from said extension housing.

4. The apparatus of claim 3 wherein said flexible coupler assembly further includes a diaphragm of resilient flexible material disposed on said outer surface of said annular flange member and having a central aperture.

5. The apparatus of claim 4 wherein said flexible coupler assembly still further includes means for attaching said diaphragm about a peripheral portion thereof to said annular flange member and for attaching said diaphragm at a central portion thereof about said central aperture thereof to said outer end of said push rod about said central hole in said push rod.

6. The apparatus of claim 5 wherein said means for attaching said central portion of said diaphragm to said outer end of said push rod includes a first plurality of fasteners with enlarged heads which overlie and engage an outer surface of said diaphragm so as to hold said central portion thereof against said outer end of said push rod.

7. The apparatus of claim 5 wherein said means for attaching said peripheral portion of said diaphragm to said annular flange member includes a second plurality of fasteners with enlarged heads which overlie and engage an outer surface of said diaphragm so as to hold said peripheral portion thereof against said annular flange member.

8. The apparatus of claim 5 wherein said diaphragm has an intermediate annular portion extending between said peripheral and central portions thereof that is free to flex so as to permit said reciprocal lengthwise movement and said wobbling side-to-side movement of said outer end of said push rod relative to said outer end of said extension housing.

9. A chiropractic percussor apparatus, comprising:

(a) a main housing adapted to be held by a user;

(b) an electric motor mounted in said main housing and having a rotary output shaft extending therefrom;

(c) an extension housing attached to an end of said main housing and extending outwardly therefrom and having an outer end defining an opening;

(d) an elongated push rod eccentrically mounted at an inner end of said rotary output shaft of said electric motor and extending through said extension housing to an outer end of said push rod having a central hole;

(e) a flexible coupler assembly supported by said outer end of said extension housing and coupled to said outer end of said push rod so as to permit said outer end of said push rod to undergo reciprocal lengthwise movement and wobbling side-to-side movement relative to said outer end of said extension housing, said flexible coupler assembly including (i) an annular flange member attached at an inner surface to said outer end of said extension housing and mounted across said opening thereof, said annular flange member having an aperture receiving said outer end of said push rod and an outer surface facing away from said extension housing, (ii) diaphragm formed by a sheet of resilient flexible material disposed on said outer surface of said annular flange member and having a central aperture, and (iii) means for attaching said diaphragm about a peripheral portion thereof to said annular flange member and for attaching said diaphragm at a central portion thereof about said central aperture thereof to said outer end of said push rod about said central hole in said push rod such that said diaphragm has an intermediate annular portion extending between said peripheral and central portions thereof that is free to flex so as to permit said reciprocal lengthwise movement and said wobbling side-to-side movement of said outer end of said push rod relative to said outer end of said extension housing; and (f) a percussion head assembly only centrally attached to said outer end of said push rod at said central hole therein, said percussion head assembly including (i) a pad support member having a plate, a single fastener mounted centrally on said plate and extending outwardly therefrom through said central aperture of said diaphragm and tightly fitted into said central hole in said outer end of said push rod so as to mount said pad support member directly to said outer end of said push rod by said centrally-located single fastener extending through said central aperture in said central portion of said diaphragm, and a pair of fasteners attached on said plate at locations spaced from opposite sides of said single fastener and extending outwardly from a side of said plate facing away from said outer end of said extension housing, and (ii) a contact pad having a base and a disc of compressible foam material attached on a side said base facing away from said plate of said pad support member, said base having a pair of keyholes formed in an opposite side of said base facing toward said plate of said pad support member, said keyholes for receiving said pair of fasteners on said plate of said pad support member to mount said contact pad to said plate of said pad support member such that rotation of said output shaft of said motor causes said outer end of said push rod and said pad support member and contact pad therewith to undergo said reciprocal lengthwise motion and said wobbling side-to-side motion so as to impose percussive and massaging actions on a surface against which said contact pad is applied by the user holding said apparatus, said plate of said pad support member also having a disc of material adapted to be compressed by movement of said base of said contact pad into contact therewith and toward said plate to insert said pair of fasteners on said plate through said keyholes in said base and to expand outward and thereby lift said contact pad away from said plate, after rotation of said contact pad relative to said plate, so as to hold enlarged heads on said pair of fasteners in engagement behind portions of said base adjacent to said keyholes in said base.

10. The apparatus of claim 9 wherein said means for attaching said central portion of said diaphragm to said outer end of said push rod includes a first plurality of fasteners with enlarged heads which overlie and engage an outer surface of said diaphragm so as to hold said central portion thereof against said annular flange member.

11. The apparatus of claim 9 wherein said means for attaching said peripheral portion of said diaphragm to said annular flange member includes a second plurality of fasteners with enlarged heads which overlie and engage an outer surface of said diaphragm so as to hold said peripheral portion thereof against said annular flange member.

* * * * *